United States Patent [19]

Allison

[11] Patent Number: 4,499,942

[45] Date of Patent: Feb. 19, 1985

[54] PLATE HEAT EXCHANGER

[75] Inventor: John Allison, Crawley, England

[73] Assignee: The A.P.V. Company Limited, Crawley, England

[21] Appl. No.: 496,676

[22] Filed: May 25, 1983

Related U.S. Application Data

[63] Continuation of Ser. No. 165,342, Jul. 2, 1980, abandoned.

[30] Foreign Application Priority Data

Jul. 6, 1979 [GB] United Kingdom ..... 7923605
May 1, 1980 [GB] United Kingdom ..... 8014541

[51] Int. Cl.[3] ..... F28F 3/08

[52] U.S. Cl. ..... 165/78; 165/67; 165/166

[58] Field of Search ..... 165/78, 166, 167, 67; 248/88

[56] References Cited

U.S. PATENT DOCUMENTS 2,015,819 10/1935 Seligman et al. ..... 165/167
2,153,998 4/1939 Verderber et al. ..... 74/567
2,154,177 4/1939 Moray ..... 165/162
2,428,880 10/1947 Kintner ..... 165/167

FOREIGN PATENT DOCUMENTS 2065289 6/1981 United Kingdom ..... 165/178

*Primary Examiner*—Albert W. Davis, Jr.
*Attorney, Agent, or Firm*—Christel, Bean & Linihan

[57] ABSTRACT

In plate heat exchangers the dismantling of the pack of plates is a lengthy job which normally has to be carried out in situ. A plate heat exchanger has a frame including a head (3), a supporting pillar (7) and a movable follower (4) mounted on a top rail (2) extending between the head (3) and pillar (7) which also carries the plate pack (1). In accordance with the invention, the top rail (2) is readily releasable therefrom by bolts (13) whereby the whole plate pack (1) may be lifted clear of the frame. The follower (4) may be temporarily accommodated on the supporting pillar (7) by clamping means (10) and the roller (5) removed. The top rail may be provided with means for attachment of lifting shackles (11).

17 Claims, 9 Drawing Figures

PLATE HEAT EXCHANGER

This application is a continuation of application Ser. No. 165,342, filed July 2, 1980 now abandoned.

This invention relates to plate heat exchangers and plate evaporators.

As the term is normally understood, a plate heat exchanger or plate evaporator consists of a separable pack of heat transfer plates arranged in spaced face-to-face relationship to define fluid flow spaces therebetween. The boundaries of the fluid flow spaces are defined and sealed by gaskets, normally located in peripheral recesses in the plates. The plates are normally suspended from a top rail or carrying bar extending between a head and a supporting pillar and the pack of plates is compressed between the said head and a movable follower, also mounted on the carrying bar, by tie bars or otherwise.

Maintenance of plate heat exchangers and plate evaporators requires inter alia periodic inspection and possibly renewal of the sealing gaskets, one of which is attached to each plate. It is the normal practice to undertake this work by disconnecting or isolating the heat exchanger or evaporator from the process and service liquid streams, followed by opening of the containing frame to release the plate pack for inspection and maintenance procedures to be undertaken on individual plates. This method of maintenance, for which existing designs are suitable, requires the heat exchanger to be inoperable, that is out of service, for a considerable time, which in certain conditions of process operation means that a second, standby, heat exchanger must be available. Further this method of maintenance requires personnel to be working in the environment in which the exchanger or evaporator is situated. There are certain processes in which this environment can be hazardous to personnel.

One particular instance is the nuclear industry, where disturbance of pipework is to be avoided absolutely and allowable working time in the vicinity of the exchanger can be measured in minutes rather than hours.

According to the invention, there is provided a plate heat exchanger in which the carrying bar is releasable from the frame so that the whole pack of plates can be removed therewith bodily from the frame.

A replacement can then be installed in a short space of time, thus reducing the out-of-service time, avoiding disturbance of connecting pipework and making maintenance of the plates possible in a safe environment remote from the installation.

Preferably, the follower is releasable from the carrying bar and can be temporarily accommodated on the support pillar when the carrying bar is removed.

Also, means may be provided for temporarily preventing more than limited movement of the plates of the pack along the carrying bar during transport of the carrying bar and plates.

The invention will be further described with reference to the accompanying diagrammatic drawings, in which.

Figure 2:
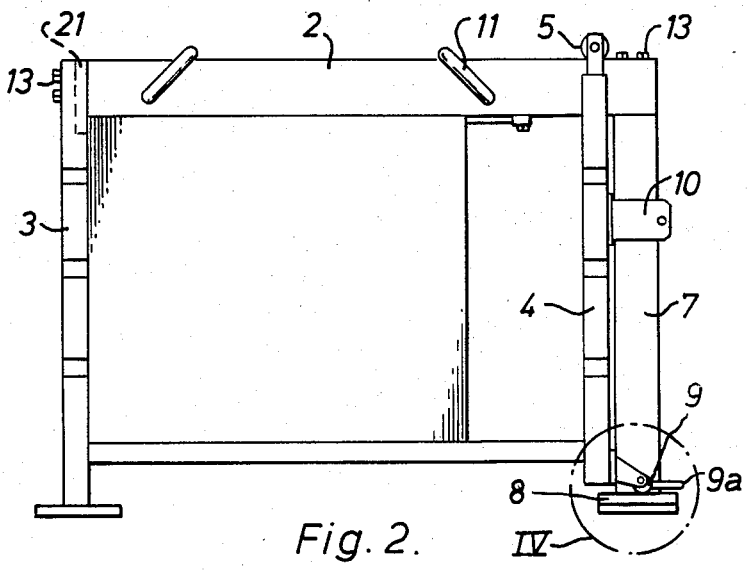
FIG. 2 is a view similar to FIG. 1 showing the equipment open for servicing.
Figure 3:
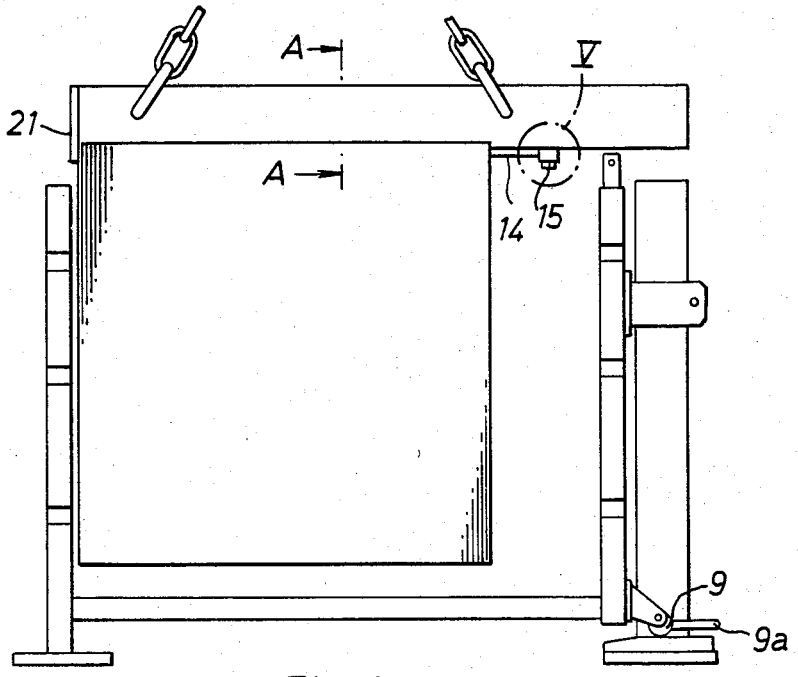
FIG. 3 is a view similar to FIGS. 1 and 2 showing the equipment dismantled to permit removal of the whole plate pack.
Figure 5A:
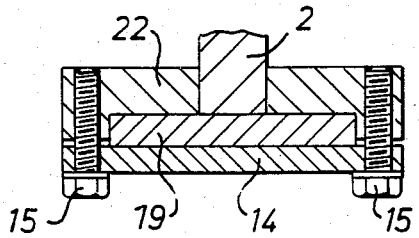
Figure 5B:
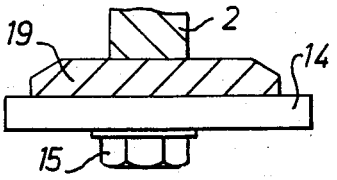
Figure 6A:
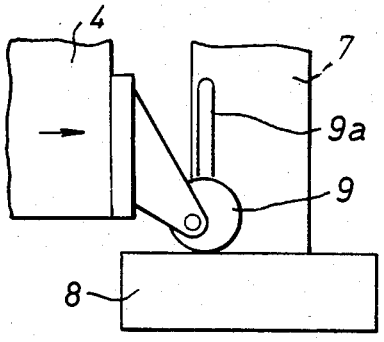
Figure 6B:
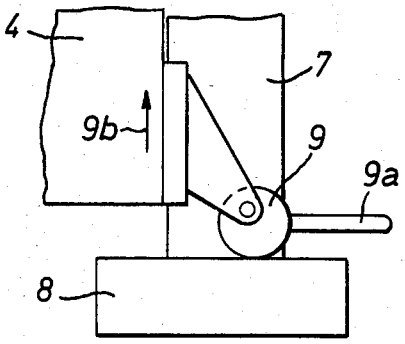
Figure 7:
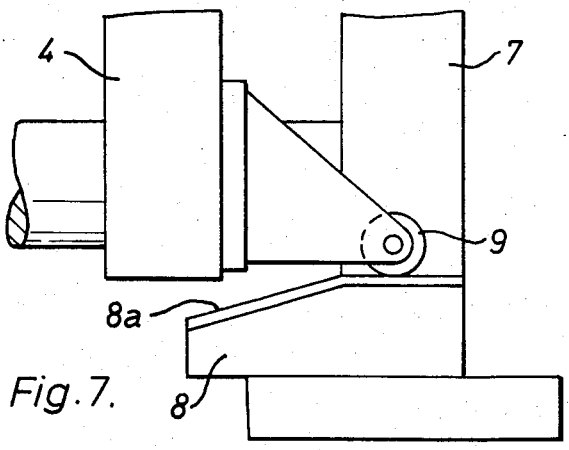

FIGS. 5*a* and 5*b* are sectional views of a detail within a circle V of FIG. 3 and show two alternative versions of this detail;

FIGS. 6*a* and 6*b* shows enlarged details from within a circle VI of FIG. 2, with parts in two different positions; and FIG. 7 shows a modification of the details of FIGS. 6*a* and 6*b*.

Figure 1:
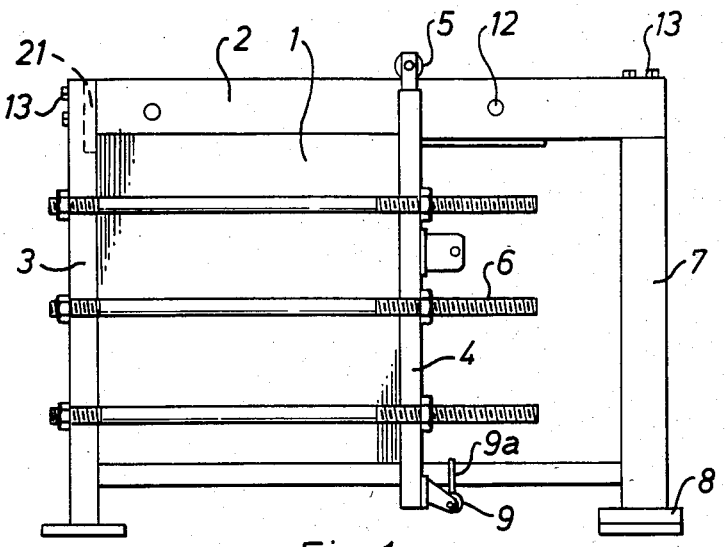
FIG. 1 is a side elevation showing a closed plate heat exchanger or evaporator.

In FIG. 1 a pack of plates 1 is shown suspended from a carrying bar 2 and clamped between a fixed head 3 and a movable follower 4. The movable follower 4 is suspended from the carrying bar 2 by means of a roller 5 and the plate pack is compressed between the head and the follower by means of tie bars 6 although other means of tightening the pack are well known and may be used as appropriate. The top bar 2 is attached at one end to the fixed head 3 and at the other end to a supporting pillar 7. Untightening and removal of the tie bars 6 permits the follower 4 to be rolled back to a position adjacent to the pillar 7 and thus expose the individual plates of the plate pack 1 for purposes of inspection and maintenance.

So far the description applies to well known and conventional designs.

In accordance with the present invention, it is proposed that the carrying bar 2 should be readily removable from the head 3 and pillar 7 so as to allow the pack of plates to be readily removed, with the carrying bar 2, for servicing at a remote location. An alternative pack of plates can then be inserted. In order for this to be done without removal of the follower 4 from the frame, the follower has to be found temporary resting place and its roller 5 moved clear of the carrying bar 2. For this purpose, a clamping means 10 is provided for support of the follower 4 on the pillar 7, while allowing some sliding motion. The follower is also provided with one or a pair of lifting cams 9 (see FIGS. 6*a* and 6*b*) normally slightly above a base 8 of the pillar 7. On being rotated by a lever 9*a* the or each cam engages the base 8 and lifts the follower upwards as indicated by the arrow 9*b* in FIG. 6*b* so that the roller 5 is raised slightly above the carrying bar 2. The roller 5, which is mounted by means of a quick release pin or shaft, can thus be readily and rapidly removed. Carrying bar 2 is provided with means for attachment of lifting shackles 11, e.g. plain holes 12 as shown in FIG. 1. The top carrying bar 2 is secured to the head FIG. 3 by attachment bolts 13, passing horizontally through the head 3 and into the top bar 2. The other end of the top carrying bar 2 rests on the pillar 7 and is secured thereto by attachment bolts 13 extending vertically through the top bar 2 and into the pillar 7. When the top carrying bar and plate pack is supported by means of the shackles and an appropriate crane or other lifting mechanism, attachment bolts 13 securing the bar 2 to the head 3 and pillar 7 can be removed, thus freeing the top bar and plates from the head 3, follower 4 and end pillar 7 so that the carrying bar 2 and plate pack 1 can be removed for servicing. A replacement bar and plate pack can then easily and quickly be installed by the reverse procedure allowing the equipment to be returned to service within a very short time, and allowing the plate pack to be dismantled for servicing at a remote location.

The head 3 has recess providing mechanical support for the carrying bar 2 in addition to that provided by the bolts 13.

As is well known, plates 18 (FIG. 4) are designed to be removed individually from the containing frame and for this purpose remain suspended from the carrying bar 2 when the frame is open but have freedom of movement allowing disengagement. In order to avoid the need for centering the pack of plates for lifting, the holes 12 for the lifting shackles are disposed substantially equally about the combined centre of gravity of the carrying bar 2 and pack 1 after removal of the follower 4. In order to stabilise the position of the pack 1 on the carrying bar 2, stop plates are provided. A fixed stop plate 21 is provided at the head end of the carrying bar and is received in a recess in the head, which thus provides mechanical support for the bar 2.

FIG. 5*a* shows a removable small stop plate 14, which is attached to a clamping plate 22 by a pair of bolts 15 adjacent to the follower end of the plate pack as shown in FIG. 3. The assembly of stop plate 14 and clamping plate 22 may be located wherever desired along the carrying bar 2 by embracing and clamping a carrying strip 19.

Figure 4:
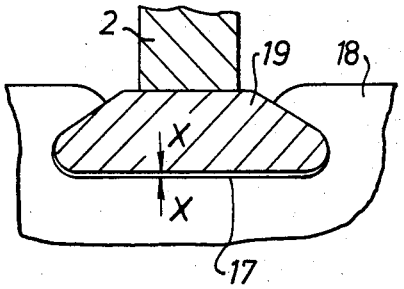
FIG. 4 is a section of the plate carrying bar, taken along line A—A of FIG. 3.

An alternative is shown in FIG. 5*b* wherein a stop plate 14 is bolted directly to the carrying strip by means of a bolt 15 received in a pre-drilled hole. The opening at the top of each plate 17 in FIG. 4 is normally provided with maximum clearance from the top bar to permit sideways removal of individual plates and avoiding dismantling of the frame for this purpose. However, in this case the converse applies. Carrying bar 2 is provided with a carrying strip 19 which is shaped to conform to the opening 17 in each plate and allow a minimum of clearance, shown between arrows 'X'—'X'. By these means the plate pack 1 can be transported with the carrying bar 2 without danger of plates becomes disengaged but at the same time when the plate pack has been removed to a site which is more suited for maintenance work the stop plate 14 can be removed from the carrying bar and plates removed by sliding along the bar one after another. Alternatively, it is possible to remove bottom portions of the carrying bar 2 at intervals as described in United Kingdom Patent Specification No. 1 129 924.

Various modifications may be made within the scope of the invention. For instance, FIG. 7 shows an alternative to the lifting cams of FIGS. 6*a* and 6*b*. The base 8 of pillar 7 is provided with a pair of ramps 8*a* and a pair of rollers 8*b* is attached to the follower 4. In operation when the follower is traversed along the carrying bar in the direction of the pillar 7, rollers 9 will travel up ramps 8*a* thus lifting and supporting the follower causing roller 5 to become disengaged from the top bar. In this position clamping device 10 is used to secure the follower 4 to the pillar 7.

Also, with smaller and lighter of plate heat exchanger, the bolts 13 at the pillar end may pass through the pillar 7 and into the top bar. Further, the pack 1 may be centralized on the top bar 2 for lifting and located by a removable clamping or holding devices.

I claim:

1. In a plate heat exchanger comprising a frame including a fixed head and a fixed supporting pillar, and a top rail extending between said head and said supporting pillar, and a pack of plates carried by said top rail and compressed between said fixed head and a movable follower mounted for movement on the top rail; the improvement comprising means for attaching the top rail to the fixed head and fixed supporting pillar in a readily releasable manner so that the top rail and pack of plates can be lifted bodily and together from the head and supporting pillar, the follower being releasably mounted on the top rail, and means for temporarily accommodating the follower on the support pillar when the top rail is removed to position the follower clear of the top rail and pack of plates so that the rail and pack of plates can be lifted as a unit.

2. A plate heat exchanger as claimed in claim 1, in which cam means is provided to lift the follower slightly in relation to the support pillar to release the follower from the top rail, and clamping means is provided to attach the follower to the support pillar with freedom for the required lifting movement.

3. A plate heat exchanger as claimed in claim 1, in which ramp means is provided to lift the follower slightly to release it from the top rail as it approaches the support pillar.

4. A plate heat exchanger as claimed in claim 1, in which the top rail is provided with means for attachment of lifting shackles.

5. A plate heat exchanger as claimed in claim 1, in which means is provided for blocking more than limited movement of the plates of the pack along the top rail during transport of the pack and top rail.

6. A plate heat exchanger as claimed in claim 5, in which the top rail is provided with a fixed stop plate at the head end and a removable stop plate is securable at or near the follower end of the pack.

7. A plate heat exchanger as claimed in claim 6, in which the removable stop plate is clampable to the top rail in any selected position.

8. A plate heat exchanger as claimed in claim 6, in which the removable stop plate is securable to a preformed hole in the top rail.

9. A plate heat exchanger as claimed in claim 1, in which the plates of the pack slide on the top rail with minimal clearance so as to be substantially restricted against any but longitudinal movement on the said rail.

10. In a frame for a plate heat exchanger comprising a fixed head, a fixed supporting pillar and a fixed top rail extending between the head and supporting pillar and supporting a movable follower: the improvement comprising means for attaching the top rail to the head and supporting pillar in a readily releasable manner so as to be lifted therefrom, the follower being releasably mounted on the top rail, and means for temporarily accommodating the follower on the support pillar when the top rail is removed to position the follower clear of the top rail and pack of plates so that the rail and pack of plates can be lifted as a unit.

11. A frame as claimed in claim 10, in which cam means is provided to lift the follower slightly in relation to the support pillar to release the follower from the top rail and clamping means is provided to attach the follower to the support pillar with freedom for the required lifting movement.

12. A frame as claimed in claim 10, in which ramp means is provided to lift the follower slightly to release it from the top rail as it approaches the support pillar and clamping means is provided to attach the follower to the support pillar.

13. A frame as claimed in claim 10, in which the top rail is provided with means for attachment of lifting shackles.

14. A plate heat exchanger as claimed in claim 1, in which said means for temporarily accommodating the follower comprises means for lifting the follower to release the follower from the top rail.

15. A frame as claimed in claim 10, in which said means for temporarily accomodating the follower comprises means for lifting the follower to release the follower from the top rail.

16. A plate heat exchanger as claimed in claim 1 wherein said top rail includes means for coupling to a lifting mechanism.

17. A frame as claimed in claim 10 wherein said top rail includes means for coupling to a lifting mechanism.

* * * * *